US008017222B2

(12) United States Patent
Wa

(10) Patent No.: US 8,017,222 B2
(45) Date of Patent: Sep. 13, 2011

(54) WATER-BASED DRAWING SURFACE AND DEVICE UTILIZING SAME

(75) Inventor: Choi Man Wa, Fanling (HK)

(73) Assignee: Battat Inc., Plattsburgh, NY (US)

( * ) Notice: Subject to any disclaimer, the term of this patent is extended or adjusted under 35 U.S.C. 154(b) by 1138 days.

(21) Appl. No.: 11/706,883

(22) Filed: Feb. 15, 2007

(65) Prior Publication Data

US 2008/0199640 A1 Aug. 21, 2008

(51) Int. Cl.
*B41M 5/00* (2006.01)

(52) U.S. Cl. ..... 428/195.1; 428/199; 428/313.9; 106/31.19

(58) Field of Classification Search ..... 428/195.1, 428/313.9, 199; 106/31.19
See application file for complete search history.

(56) References Cited

U.S. PATENT DOCUMENTS 4,028,118 A * 6/1977 Nakasuji et al. ..... 106/31.19
5,163,846 A * 11/1992 Lee ..... 434/408
5,583,088 A * 12/1996 Kawamura ..... 503/205
5,682,838 A * 11/1997 Reich ..... 119/711
6,011,098 A * 1/2000 Kashiwazaki et al. ..... 524/377
6,228,804 B1 * 5/2001 Nakashima ..... 503/226
6,416,853 B1 * 7/2002 Nakashima et al. ..... 428/313.9
6,964,807 B2 * 11/2005 Nakashima et al. ..... 428/199

* cited by examiner

*Primary Examiner* — Bruce H Hess
*Assistant Examiner* — Tamra L Amakwe
(74) *Attorney, Agent, or Firm* — Andrew S. Langsam; Barry E. Negrin; Pryor Cashman LLP

(57) ABSTRACT

A water-based drawing surface and a toy employing same are disclosed. The drawing surface includes a plastic substrate layer and a fabric layer adhered to the plastic substrate layer. A substantially water-resistant layer is applied to the fabric layer, and an ink layer is applied to the substantially water-resistant layer. The ink layer includes ink imprinted thereon, the ink being water-soluble when initially applied to the substantially water-resistant layer and insoluble after the ink has dried on the substantially water-resistant layer. When water is applied to the ink layer after the ink has dried thereon, the ink layer darkens in the shape of the water applied thereto. The ink is preferably screen-printing ink and it is preferably hand brushed onto the fabric layer.

16 Claims, 3 Drawing Sheets

SECTIONA-A

ASSEMBLY

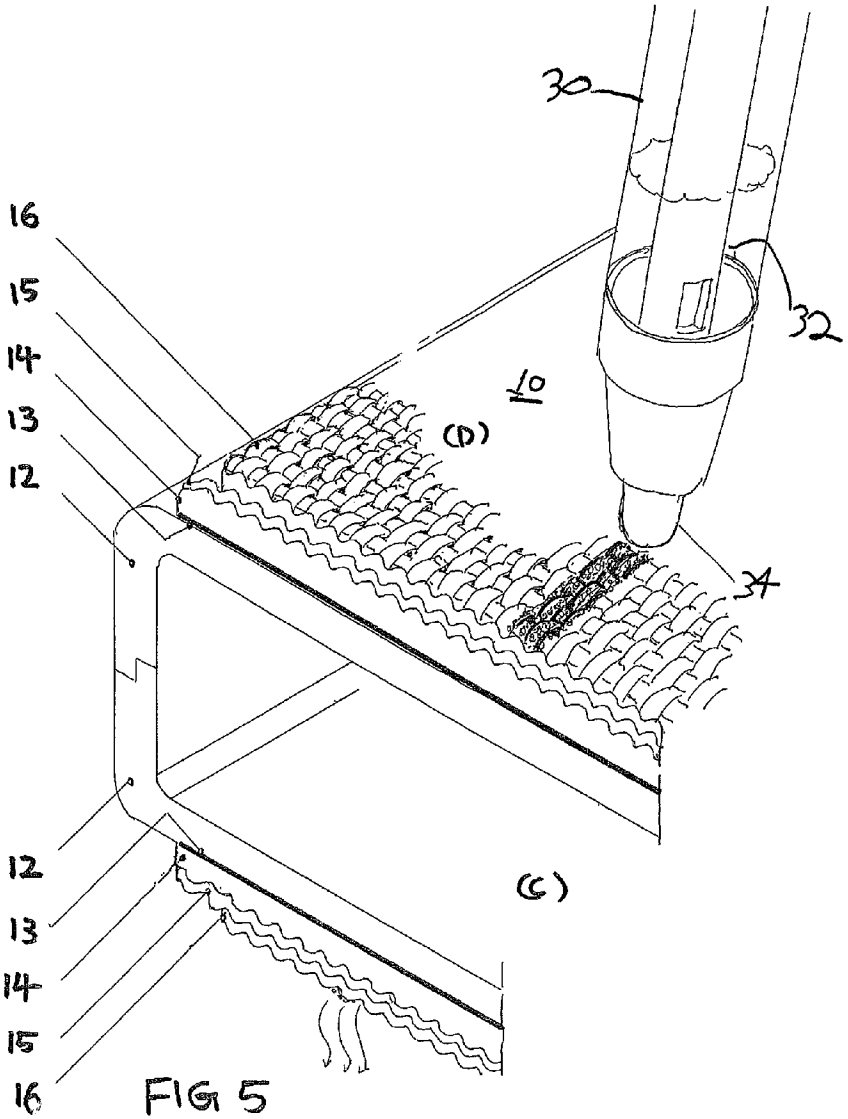
FIG 5
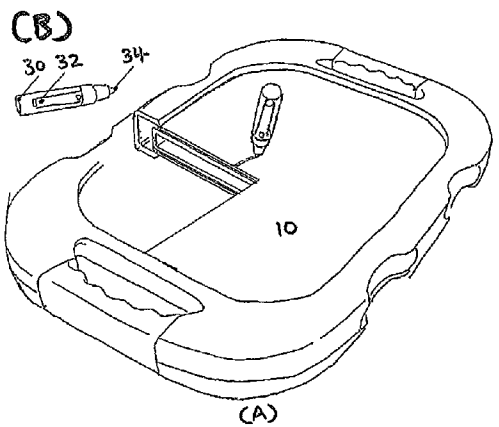

WATER-BASED DRAWING SURFACE AND DEVICE UTILIZING SAME

BACKGROUND OF THE INVENTION

Field of the Invention

The invention relates to children's drawing toys, and more specifically, to water-based children's drawing toys in which the drawing surface is re-usable.

There are many known children's drawing devices which allow a child to draw an image in an impermanent manner so that the drawing surface may be used repeatedly. Among them are a genre in which a drawing surface appears white or grey but when water is applied thereto, the color changes. Such devices are described in U.S. Pat. Nos. 4,810,562 to Okawa et al. and 6,416,853 to Nakashima et al., the teachings of which are hereby incorporated by reference.

Both of the Okawa and Nakashima devices, as well as many other water-based drawing toys in the field, require one or more layers of the device to be impregnated with silica or some form of silicic acid in order to have the color-changing or light-transmissibility changing properties needed for the toy to work properly. In practice, the color- and/or transmissibility-changing properties of these devices fades over time. Specifically, after as little as 2-3 months of use (i.e., a child drawing on the surface with water), drawing performance deteriorates noticeably, resulting in blurred imaged and/or unresponsive areas that will not change color/appearance when applied with water. Additionally, the drying time of conventional water-based drawing toys is unacceptably long, in the range of 2-3 minutes. During such a length of time, a child (or even an adult) tends to become frustrated with the toy and plays with something else while waiting for the previous image to dry.

Accordingly, there is a long-felt need to create a water-based temporary image drawing toy having a longer useful life span, has a quicker drying time, and that may be produced less expensively than prior attempts.

SUMMARY OF THE INVENTION

The invention is a water-based toy drawing device, the drawing surface of which includes a plastic substrate layer and a fabric layer adhered to the plastic substrate layer. A substantially water-resistant layer is applied to the fabric layer, and an ink layer is applied to the substantially water-resistant layer. The ink layer includes ink imprinted thereon, the ink being water-soluble when initially applied to the substantially water-resistant layer and insoluble after the ink has dried on the substantially water-resistant layer. When water is selectively applied to the ink layer by the child, after the ink has dried thereon, the ink layer darkens at the locations where the water has been applied thereto, yet the water does not soak through the fabric layer, owing to the water-resistant layer. An image may be imprinted onto the water-resistant layer, so that when the ink layer is wetted, the ink becomes at least partially translucent and the image is at least partially visible through the wetted ink layer. The fabric layer is preferably completely glued to the plastic substrate layer.

In the preferred embodiment, the ink is screen printing ink which preferably includes approximately 20-30% urethane resin, 20-30% filler, and 40-50% water. The ink is preferably hand brushed onto the water-resistant layer. Unlike in the prior art, the fabric layer is not impregnated with silica or a silicic acid of any kind.

In a preferred embodiment, the water-resistant layer further comprising a paint layer including when wet a mixture of water-based paint, water-based sealant, and water. Preferably, the water-based paint further comprises acrylic emulsion paint, and the ink further comprises a mixture of color-changing ink, water, and water-based dye. The color-changing ink, water, and water-based dye are preferably in the ratio of approximately 1:5:0.15, and the water-based paint, the water-based sealant, and the water are in the ratio of approximately 4:1:1.

The inventive toy drawing device may further include a portable reservoir for containing water for application onto the fabric layer. The portable reservoir may be shaped like a pen or similar writing/drawing implement.

BRIEF DESCRIPTION OF THE DRAWINGS

FIG. 5(A) is a perspective schematic view of a water-based child's drawing toy in accordance with the invention.

FIG. 5(B) is a perspective schematic view of a water reservoir for use with the toy of FIG. 5(A).

FIG. 5(C) is a broken-away perspective sectional view of a preferred embodiment of a toy in accordance with the invention.

FIG. 5(D) is an enlarged schematic view of the upper surface of a drawing surface in accordance with the invention.

DESCRIPTION OF THE PREFERRED EMBODIMENTS AND DRAWINGS

Description will now be given of the invention with reference to the attached FIGS. 1-6. It should be understood that these figures are exemplary in nature and in no way serve to limit the scope of the invention which is defined by the claims appearing hereinbelow.

Figure 1:
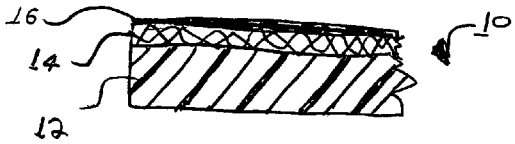
FIG. 1 is an enlarged sectional view of a drawing surface of a water-based child's drawing toy in accordance with the invention.
Figure 6:
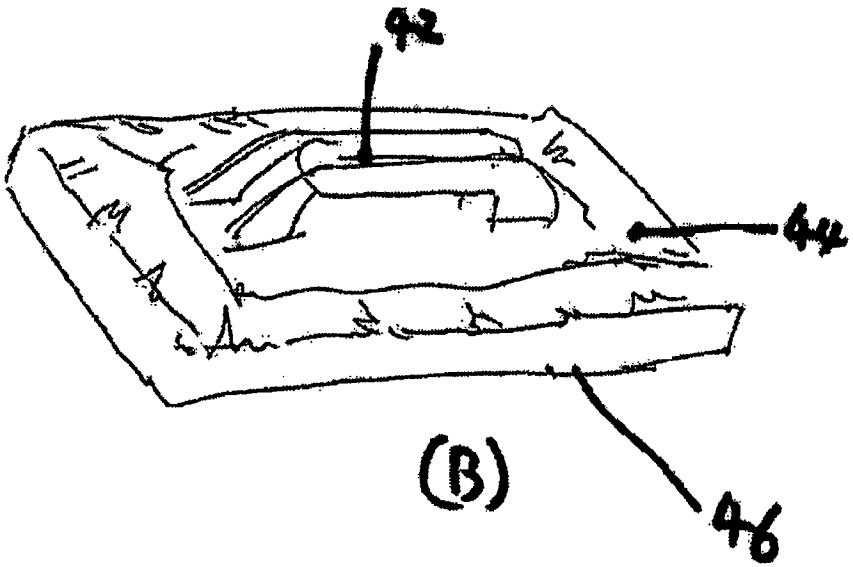
FIG. 6(A) is a schematic illustrating a step in the process of manufacturing a drawing surface in accordance with the invention.
FIG. 6(B) is a schematic illustrating a hand tool used in the manufacturing step of FIG. 6(A).
Figure 6:
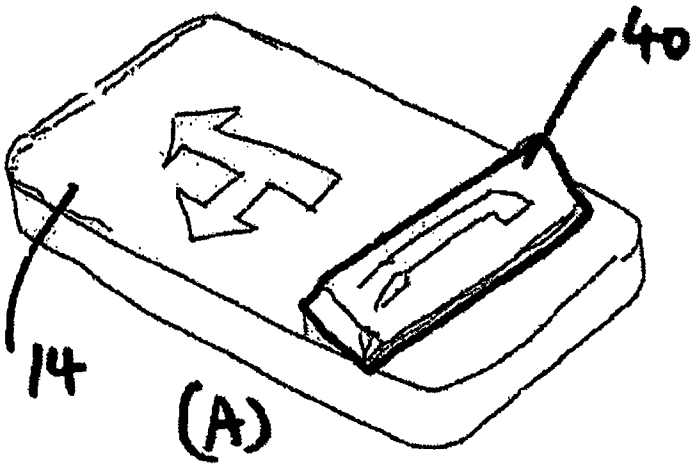

A basic embodiment of the inventive drawing surface 10 of the device is shown in section in FIG. 1. Unlike the prior art which required use of silica or other forms of silicic acids to be impregnated in one or more layers of the drawing surface, drawing surface 10 does not need any silica or silicic acid. Instead, a plastic substrate layer 12 is provided, and a fabric layer 14 is attached thereto. Preferably, fabric layer 14 is adhered to plastic substrate layer 12 via adhesive, and preferably is entirely adhered thereto over its entire surface area (not simply along the perimeter and with no gaps or spaces). Instead of using silica or silicic acid, water-soluble ink 16 is imprinted onto fabric layer 14 which, when dry, becomes water insoluble. Ink 16 is preferably screen printing ink which preferably includes approximately 20-30% urethane resin, 20-30% filler, and 40-50% water. The ink may be hand brushed onto fabric layer 14 as described below. One preferred such ink is color changing ink J-10 manufactured by Tanaka Chemical Industries, Ltd. of Japan.

A preferred embodiment of the inventive drawing surface is depicted in FIG. 5(A)-(D). Like elements are designated by like reference numerals, and their description will not be repeated. FIG. 5(C) shows a more complete version of the invention. Atop plastic substrate layer 12 is provided adhesive layer 13 to which fabric layer 14 is affixed. The fabric has a textured surface 14A (see FIG. 5(D)) which tends to hold moisture better, so that the drawn-on area will show darker than the undrawn-on area. Fabric layer 14 preferably includes a paint layer 15 made of a dried water-based paint, and ink 16 is imprinted thereon as described above. One purpose of paint layer 15 is that, when water is applied to drawing surface 10, paint layer 15 keeps the moisture on the upper surface of the drawing surface 10 and does not allow it to soak through to the underside. Another function of paint layer 15 is to localize applied water and prevent the image drawn from bleeding or spreading significantly. The textured surface 14A of fabric layer assists in drawing the water down from the water source easily, and paint layer 15 prevents the water from spreading or bleeding too far away from where the water was applied. Since paint layer 15 prevents the water from soaking into the fabric layer, rapid (but not too rapid) evaporation of water applied thereto is insured.

The drawing surface 10 may be provided with a portable water reservoir, e.g., a pen-shaped device having a container for holding water and a porous, wicking, or otherwise non-watertight end for dispensing water in a manner similar to writing or drawing. One such device is shown in FIG. 5(B) as water pen 30, having a reservoir 32 and a tip 34 in communication with the reservoir. Alternatively, the user may employ other water-bearing devices such as a sponge. In either event, the user selectively applies water to areas of the drawing surface, which makes the ink look darker and slightly translucent wherever the water is applied. This localized darkening of the ink on the fabric enables designs, words, or the like to be drawn simply by applying water to the surface of the device. Water so applied to the ink layer will eventually dry by evaporation, leaving the toy looking as it did prior to the application of any water. The device is thus reusable.

An image may be imprinted onto or in paint layer 15 so that when the ink layer is wetted, the ink becomes at least partially translucent and the image is at least partially visible through the wetted ink layer.

Figure 2:
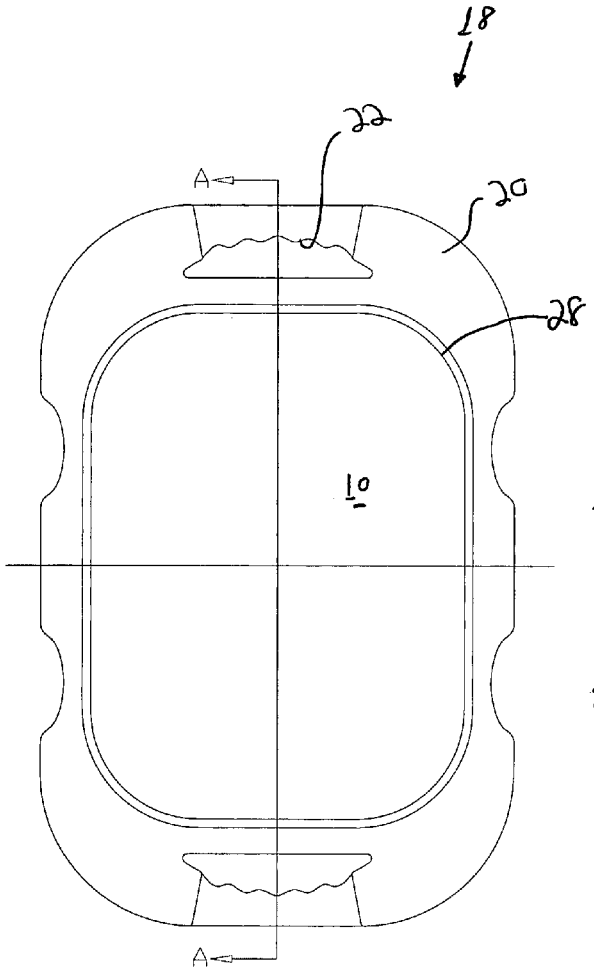
FIG. 2 is a top elevational view of a water-based child's drawing toy in accordance with the invention.
Figure 4:
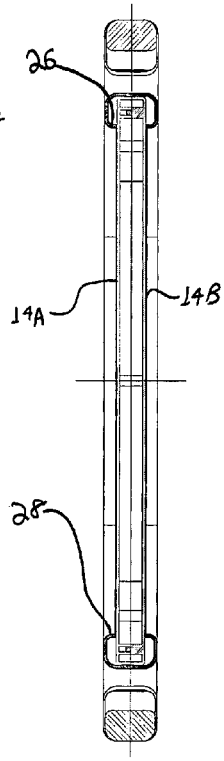
FIG. 4 is a side sectional view of the toy of FIG. 2 taken along line A-A.
Figure 3:
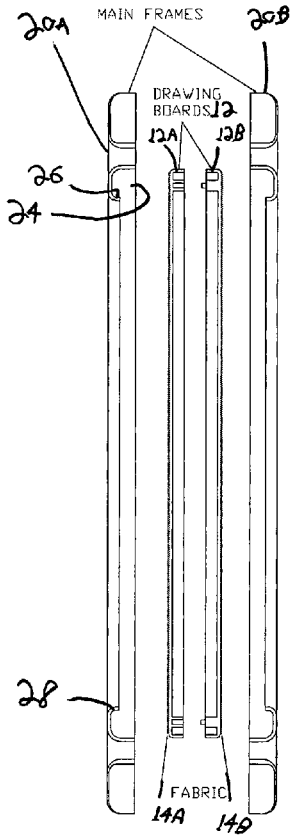
FIG. 3 is a side exploded elevational view of the toy of FIG. 2.

FIGS. 2-4 depict one embodiment of a toy 18 employing the inventive drawing surface 10. Toy 18 includes a main housing 20 provided with one or more handles 22, as shown in FIG. 2. It is preferred that toy 18 has two drawing surfaces, one on either side of main housing 20, as shown in FIGS. 3-4. In one embodiment, two substrates 12A-B are each respectively provided with a fabric layer 14A-B as described above with respect to FIG. 5C, which are, in turn, each provided with ink 16 atop paint layer 15 as described above. Optionally, fabric layer 14A may be provided with a different color of ink 16, or a different pattern of ink 16, than fabric layer 14B. Substrates 12A-B may be attachable together via a pin-and-socket system, for example, as shown in FIG. 3.

Main housing 20 may include two housing sections 20A-B (See FIG. 3) each having a recess 24 for receiving one of the drawing surfaces. Recess 24 is preferably provided with a shoulder 26 which allows a drawing surface to be inserted into recess 24 but does not allow the drawing surface to fall through window 28 on the other side of housing section 20A-B.

Description of the manufacture of a specific preferred embodiment will now be given.

First, canvas fabric, preferably 10 oz. fabric, is cut to size and treated to have fewer stray fibers sticking up or out of the upper surface. The preferred size of the fabric is about 9⅞×13 inches, approximately 0.017 inches thick. A mixture of paint, sealant, and water is prepared, preferably in the ratio of 4:1:1. The paint is preferably water-based paint, e.g., acrylic emulsion paint or even conventional wall paint. Roughly one ounce of the paint mixture is poured into a silk screen net, and three passes are made over the fabric. This first coating of paint is allowed to dry or dried in a heat tunnel, and then preferably a second coating of paint is applied with three passes. Once the second coating is dry, the painted fabric layer is ready.

With the paint layer made in this fashion, water is not able to soak all the way through the fabric, as mentioned above, and moisture will evaporate roughly 20-30% in 15 seconds, 40-50% in 30 seconds, 70-90% in 45 seconds, and completely within a minute under normal conditions (in a hot, dry climate, applied moisture will evaporate faster).

Next, a mixture of color changing ink J-10, water, and water-based dye is prepared, preferably in a ratio of 1:5:0.15. In the preferred embodiment, the dye is either purple or orange, however any color may be used. About 5 grams of this mixture is poured onto the fabric layer in a manner similar to that of the application of the paint layer. It is preferably applied by hand via a hand tool like the one shown in FIG. 6(A)-(B). Tool 40 includes handle 42 for easy handling attached to a core of high density foam, e.g., polyurethane foam, which is, in turn, wrapped in a cloth 44 to form a palette suitable for hand brushing. Other similar tools may be employed. In any event, the ink/water/dye mixture is applied via brushing in as thin a coating as possible, allowed to dry, and then a second 5 gram coating is applied in the same manner. This dual-coating layer has to be thin and even, so that when the moisture contacts it, the lines drawn by the child will be sharper and clearer. This thin ink layer allows stored moisture in the "valleys" of the fabric to evaporate more stably and consistently, so that all portions of a drawn line disappear at substantially the same time.

Finally, the drawing surface is preferably ironed. Ironing makes the fabric surface smoother, eliminating stray fibers that may stick up. The rate at which drawn images disappear is accelerated for surfaces that are ironed.

Having described the invention with reference to one or more embodiments, it is to be understood that the scope of the invention is not limited to those embodiments described above or shown in the drawings but, rather, is defined by the claims appearing hereinbelow and all reasonable equivalents thereof.

What is claimed is:

1. A water-based toy drawing device having a drawing surface, comprising:

a plastic substrate layer;

a fabric layer adhered to said plastic substrate layer;

a substantially water-resistant layer applied atop said fabric layer; and an ink layer applied atop said substantially water-resistant layer, including ink imprinted thereon, said ink being water-soluble when initially applied to said substantially water-resistant layer and insoluble after said ink has dried on said substantially water-resistant layer;

wherein said fabric layer, said water-resistant layer, and said ink layer form said drawing surface, and wherein when water is applied to said water-resistant layer after said ink has dried thereon, said ink layer darkens in the shape of the water applied thereto, and wherein said drawing surface does not include silica or a silicic acid.

2. A water-based toy drawing device according to claim 1, further comprising a reservoir for containing water for application onto said ink layer.

3. A water-based toy drawing device according to claim 2, wherein said reservoir is shaped like a pen.

4. A water-based toy drawing device according to claim 1, wherein said ink comprises screen printing ink.

5. A water-based toy drawing device according to claim 4, said screen printing ink comprising approximately 20-30% urethane resin, 20-30% filler, and 40-50% water.

6. A water-based toy drawing device according to claim 1, wherein said ink is hand brushed onto said water-resistant layer.

7. A water-based toy drawing device according to claim 4, wherein said screen printing ink is hand brushed onto said water-resistant layer.

8. A water-based toy drawing device according to claim 5, wherein said screen printing ink is hand brushed onto said water-resistant layer.

9. A water-based toy drawing device according to claim 1, wherein said fabric layer is completely glued to said plastic substrate layer.

10. A water-based toy drawing device, comprising:

a main housing;

a first plastic substrate layer attached to said main housing;

a first fabric layer adhered to said first plastic substrate layer;

a first substantially water-resistant layer applied atop said first fabric layer;

a first ink layer applied atop said first substantially water-resistant layer, including ink imprinted thereon, said ink being water-soluble when initially applied to said first substantially water-resistant layer and insoluble after said ink has dried on said first substantially water-resistant layer;

a second plastic substrate layer attached to said main housing and a second fabric layer having second of said water-resistant and ink layers applied thereto, wherein when water is applied to said first and second water-resistant layers after said ink has dried thereon, said first and second ink layers darken in the shape of the water applied thereto.

11. A water-based toy drawing device according to claim 10, wherein said fabric layer is disposed on a first side of said main housing and said second fabric layer is disposed on a second opposite side of said main housing.

12. A water-based toy drawing device according to claim 1, said water-resistant layer further comprising a paint layer including a mixture of water-based paint, water-based sealant, and water.

13. A water-based toy drawing device according to claim 12, wherein said water-based paint further comprises acrylic emulsion paint.

14. A water-based toy drawing device according to claim 1, wherein said ink further comprises a mixture of color-changing ink, water, and water-based dye.

15. A water-based toy drawing device according to claim 14, wherein said color-changing ink, water, and water-based dye are in the ratio of approximately 1:5:0.15.

16. A water-based toy drawing device according to claim 15, wherein said water-based paint, said water-based sealant, and said water are in the ratio of approximately 4:1:1.

* * * * *